US006944980B1

(12) United States Patent
Lefrancois

(10) Patent No.: US 6,944,980 B1
(45) Date of Patent: Sep. 20, 2005

(54) COMBINATION SHOVEL BRUSH TOOL

(76) Inventor: Jacqueline J. Lefrancois, 144 Lakeshore Dr., Blackstone, MA (US) 01504

( * ) Notice: Subject to any disclaimer, the term of this patent is extended or adjusted under 35 U.S.C. 154(b) by 0 days.

(21) Appl. No.: 10/993,347

(22) Filed: Nov. 19, 2004

Related U.S. Application Data

(60) Provisional application No. 60/525,031, filed on Nov. 25, 2003.

(51) Int. Cl.[7] ..... E01H 5/02
(52) U.S. Cl. ..... 37/285
(58) Field of Search ..... 294/50.8, 50.9, 294/51, 54.5, 53.5; 7/114–116; 15/105, 111, 15/114, 117; 37/265, 284, 285; 172/371–378

(56) References Cited

U.S. PATENT DOCUMENTS

| | | | | | |
|---|---|---|---|---|---|
| 3,772,490 | A | * | 11/1973 | Thordarson | 200/286 |
| 4,143,899 | A | * | 3/1979 | Wetherall et al. | 294/50.9 |
| 4,153,287 | A | * | 5/1979 | Towsend | 294/51 |
| 4,214,385 | A | * | 7/1980 | Baranowski et al. | 37/434 |
| 5,309,654 | A | * | 5/1994 | Mathis | 37/284 |
| D355,075 | S | * | 2/1995 | Stone | D4/118 |
| 5,727,829 | A | * | 3/1998 | Bellichak | 294/51 |

* cited by examiner

*Primary Examiner*—Robert E Pezzuto
(74) *Attorney, Agent, or Firm*—Robert J Doherty

(57) ABSTRACT

A combination shovel broom tool that includes a shovel blade, a broom mounted behind the blade and including bristles that extend downwardly and terminate in a bristle working surface such that the blade and bristle working surface can simultaneously clean a surface as the device is pushed along the surface to be cleaned and a wheel set disposed within the bristles to facilitate such pushing action.

3 Claims, 4 Drawing Sheets

COMBINATION SHOVEL BRUSH TOOL

This application claims the benefit of U.S. Provisional Patent Application No. 60/525,031 filed Nov. 25, 2003 entitled SHOVEL BROOM ON WHEELS.

BACKGROUND OF THE INVENTION

This invention relates to a tool that can be utilized to remove debris and/or snow or other material from surfaces such as sidewalks, bridges, basement floors, patios, decks, driveways, and the like.

Generally the acts of brushing and shoveling to remove debris including dirt, dust, leaves and snow from such surfaces has been performed by two separate tools, i.e., shovels and brushes or brooms. However, distinct advantages can be achieved by incorporating both tools in a single unit. Such shovels/brushes are not entirely new however. Prior art devices which embody both functions on a single tool have been hitherto either too sophisticated or too simplistic, and the need exists for a useful combination tool that can be used utilized in various operational modes, that is, used singly as a shovel, used as a combination shovel and brush and utilized only as a brush or broom.

Prior art patents which embody general shovel/brush combinations but which do not afford the above desired flexibility include the following U.S. patents: U.S. Pat. No. 634,963 to Smith issued Oct. 17, 1899; U.S. Pat. No. 1,143,752 to Crisman issued Jun. 22, 1915; U.S. Pat. No. 1,922,998 issued Aug. 15, 1933 to William; U.S. Pat. No. 4,153,287 issued May 8, 1979 to Townsend; and U.S. Pat. No. 4,346,928 issued Aug. 31, 1982 to Townsend.

It is, accordingly, a basic object of the present invention to provide a combination/brush tool which can be operationally used in various alternative modes but which normally functions in a straightforward manner in which both the broom and shovel aspects of the device contribute to the cleaning action. A further object of the present invention is to provide a device of minimal cost that is naturally intuitive in use and of simple low-cost construction.

These and other objects of the present invention are accomplished by a combination tool including a handle having an upper end and a lower end and terminating at its lower end in a terminal housing in turn supporting both a shovel and a broom, said shovel including a blade having a forward face terminating at a lower longitudinally extending working edge adapted to contact surfaces to be cleaned of debris or snow, said broom including a longitudinally extending head having a lower surface face and a bristle portion in turn downwardly extending from said lower surface face, said bristle portion having a plurality of vertically oriented semi-rigid bristles attached thereto and downwardly extending from said head lower surface face and in turn forming a lower composite generally planar bristle working surface adapted to contact surfaces to be cleaned of debris or snow, said blade lower edge and said bristle working surface being disposed in the same horizontal plane in a first operational position of said tool when said tool is disposed upon said surface to be cleaned with said blade lower edge positioned forward of said broom and both said blade lower edge and said bristle working surface contacting said surface to be cleaned, said broom further including a wheel set including at least a pair of longitudinally spaced wheels positioned within said bristle portion, said wheels in turn adapted to support said tool on the surface to be cleaned as the tool is pushed forwardly along the surface to be cleaned and when said tool is positioned in an alternate use position where the blade lower edge is upwardly tilted above the surface to be cleaned.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
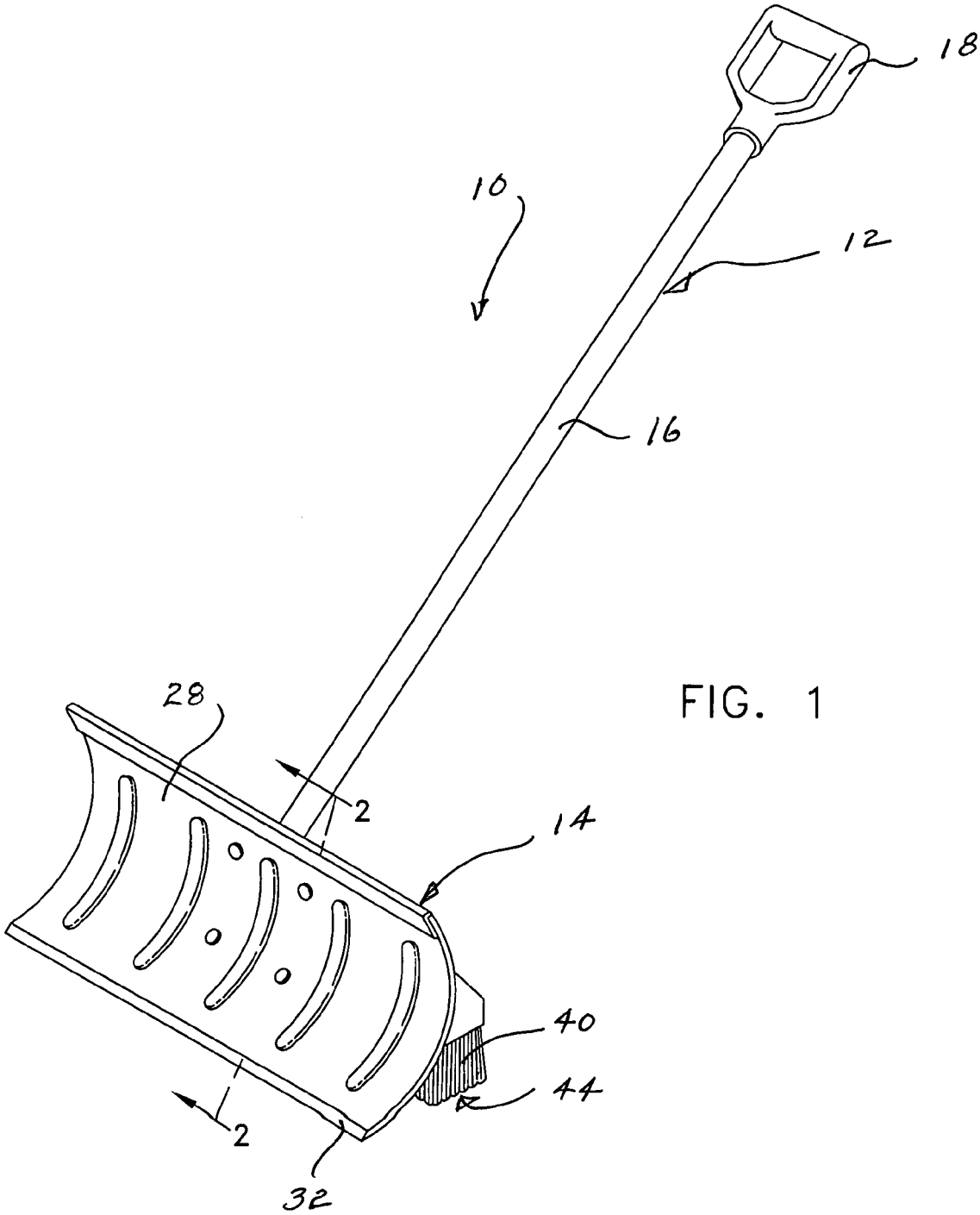
FIG. 1 is an overall front perspective view showing the device of the present invention.

Turning now to the drawings, it will be apparent that the combination tool 10 of the present invention includes both a brush or broom 12 and a shovel 14. Both components of the combination tool 10 are controlled or manipulated by a handle 16 terminating in a grip 18, if desired, at the upper terminal end thereof. The longitudinally extending handle terminates at its lower end in a terminal housing 20 that in turn either directly or indirectly supports both the broom 12 and the shovel 14. In its simplest form as shown in the drawings, the terminal housing 20 includes a flange 22 upwardly angularly extending from a plate 24 that in turn is connected as by bolts, screws and the like 26 to the body portion 28 of the shovel 14. The shovel 14 further includes a front face 30 and a lower terminal edge 32.

Figure 2:
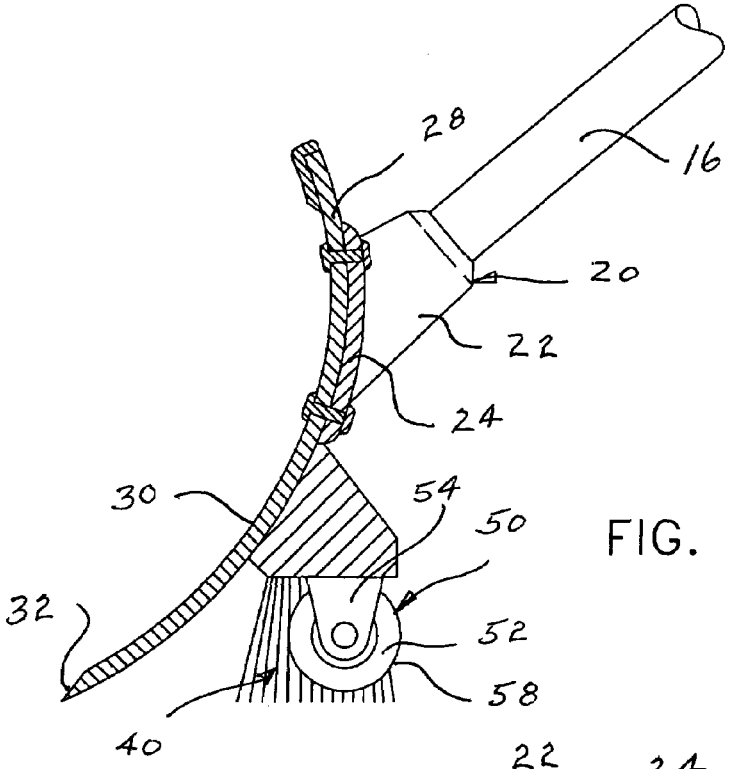
FIG. 2 is a side sectional elevational view taken along the line 2—2 of FIG. 1.
Figure 3:
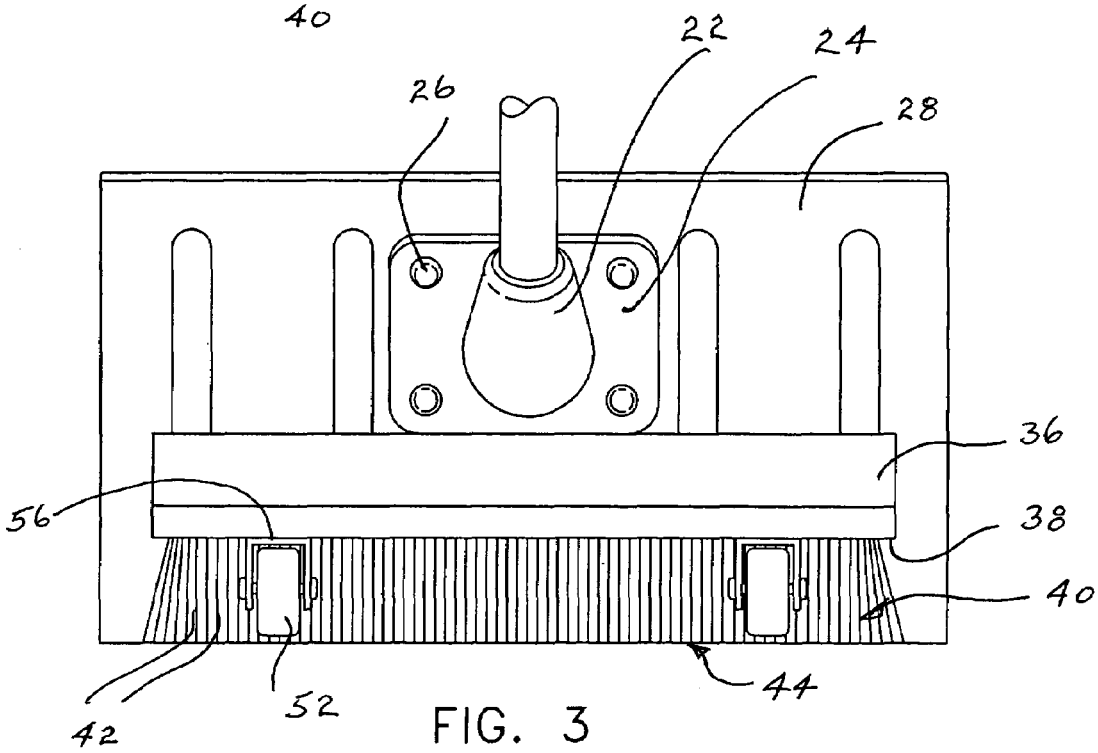
FIG. 3 is a partial rear view thereof.
Figure 4:
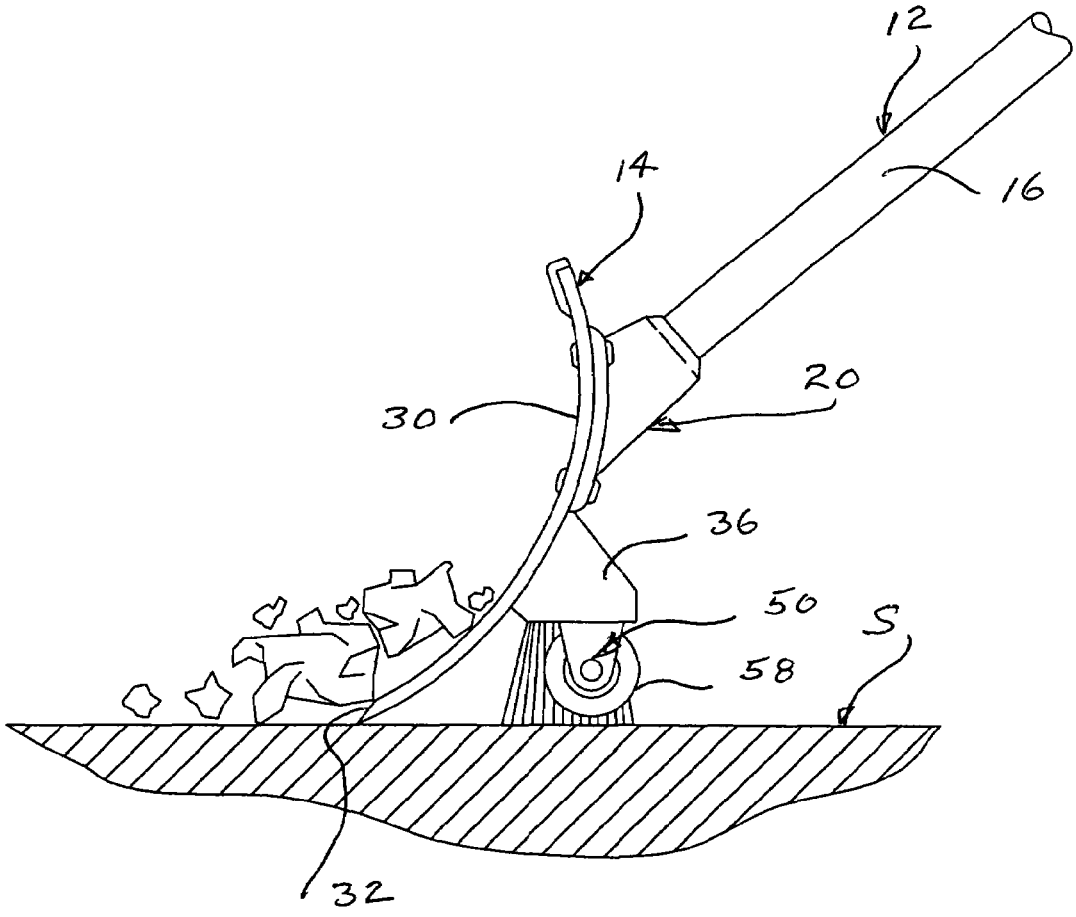
FIG. 4 is a partial side view showing the normal operational manner of the tool of the present invention.

The broom 12 includes a longitudinally extending head 36 that defines a lower face 38 from which a bristle portion 40 depends. Such bristle portion 40 is composed of a plurality of individual semi-rigid bristles 42 preferably secured to the head 36 by known means such a gluing, clamping and the like. The bristles downwardly extend from the lower face 38 and terminate in a working surface 44 in the tool's normal resting and working positions shown in FIGS. 2 and 4 and lies in the same horizontal plane as the surface S that is to be cleaned of debris such as leaves, snow and the like. Stated differently, the tool is adapted to rest upon the working surface of the bristle portion and the lower working edge of the blade's lower edge. In such position, the blade's lower edge 32 and the bristles' working surface 44 are in the same plane.

It should be pointed out that the broom head in the specific embodiment shown in the drawings comprises a portion of the terminal housing 20 and could be directly connected thereto or, as shown in the drawings, may be connected directly to the shovel blade's rear surface as by adhesive or other known means or the broom head could simply be molded integrally with the shovel blade or alternatively formed as a portion of the plate 24.

Positioned within the bristle portion 42 is a wheel set 50 that is shown in the drawings as including at least a pair of longitudinally separated wheels 52 secured for rotation within U-shaped flanges 54 in turn having a base 56 attached to the lower face of the broom head. An essential feature of the wheel set 50 is that the wheels 52 are positioned within the bristle portion and their outer peripheral surfaces or treads 58 are adapted to extend either to the bristle's working surface 44 or slightly there above such that when the tool is moved forwardly and horizontally across the surface S to be cleaned the bristles can slightly bend or flex such that the wheel treads 58 contact the surface S to facilitate the tool's forward movement in a smooth and efficient manner while still pushing debris left by the forwardly disposed blade from the surface S to be cleaned being cleaned.

The wheels 52 are free to rotate in either direction on an axle extending between the flanges 54. In addition, the wheel set could be mounted so as to be vertically adjustable to various positions such that the wheel treads can be flush with the bristle working surface or somewhat there above as indicated in the drawings. The wheel set could also include telescoping mounting where the wheels are spring urged downwardly against the surface S but are free to move upwardly into the bristle portion.

Figure 5:
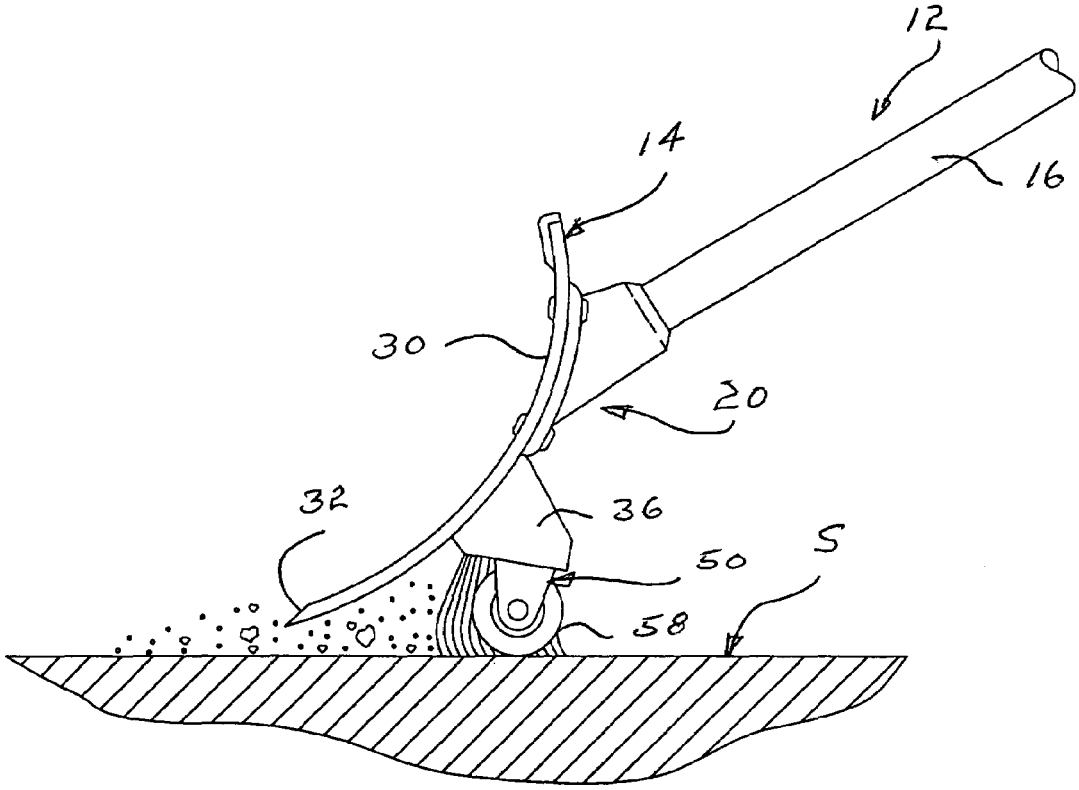
FIG. 5 is a view showing an alternate mode of the invention wherein only the brushing action is brought about by the tool.

The aforementioned operational manner is the normal mode in which the tool of the present invention is utilized. However, an alternate form is shown in FIG. 5 wherein the handle 16 is downwardly rearwardly tilted such that the blade lower edge 32 is elevated above the surface S to be cleaned and the entire cleaning procedure is essentially provided by the forward movement of the brush portion while being supported on the wheel set 50. In addition to the above alternative operational form, the tool could also be operated in a manner wherein only the blade edge 32 contacts the surface S to be cleaned; and in that embodiment (not shown), the handle would be upwardly forwardly tilted such that the bristle portion would be completely out of contact with the surface being cleaned and forward movement provided by a somewhat scraping forward motion of the blade. (The first previously discussed and alternate operational modes, however, are the preferred embodiments of the invention.)

The bristles are semi-rigid in that they are stiff enough to carry a portion of the weight of the combination tool as above described yet flexible enough to bend such that they move with ease in the desired cleaning across the surface S to be cleaned that could include surface irregularities such as rough concrete or surface depressions and the like. The bristles may be formed from thin metal, natural fibrous materials, extruded plastic and the like. The broom head may be similarly constructed from suitable materials that further may include wood, fiberglass and the like as is the handle 16. The blade is generally formed from a plastic, metal or rubber suitable for the purpose.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A combination tool including a handle having an upper end and a lower end and terminating at its lower end in a terminal housing in turn supporting both a shovel and a broom, said shovel including a blade having a forward face terminating at a lower longitudinally extending working edge adapted to contact surfaces to be cleaned of debris or snow, said broom including a longitudinally extending head having a lower surface face and a bristle portion in turn downwardly extending from said lower surface face, said bristle portion having a plurality of vertically oriented semi-rigid bristles attached thereto and downwardly extending from said head lower surface face and in turn forming a lower composite generally planar bristle working surface adapted to contact surfaces to be cleaned of debris or snow, said blade lower edge and said bristle working surface being disposed in the same horizontal plane in a first operational position of said tool when said tool is disposed upon said surface to be cleaned with said blade lower edge positioned forward of said broom and both said blade lower edge and said bristle working surface contacting said surface to be cleaned, said broom further including a wheel set including at least a pair of longitudinally spaced wheels positioned entirely within said bristle portion, said wheels in turn adapted to support said tool on the surface to be cleaned as the tool is pushed forwardly along the surface to be cleaned and when said tool is positioned in an alternate use position where the blade lower edge is upwardly tilted above the surface to be cleaned.

2. The tool of claim 1, wherein said wheels include an outer tread the lowermost surfaces of which are disposed above said bristle working surface.

3. The tool of claim 1, wherein said broom head is attached to a rear portion of said shovel blade.

* * * * *